United States Patent [19]

Aileo

[11] 4,170,042

[45] Oct. 9, 1979

[54] READILY RELEASABLE POWERED VISOR-AND-LOCK ASSEMBLY FOR HELMET

[75] Inventor: Jackson A. Aileo, Carbondale, Pa.

[73] Assignee: Gentex Corporation, Carbondale, Pa.

[21] Appl. No.: 875,179

[22] Filed: Feb. 6, 1978

[51] Int. Cl.[2] ..... A42B 3/00

[52] U.S. Cl. ..... 2/424; 2/6

[58] Field of Search ..... 2/6, 10, 424, 15, 8, 2/7, 427, 425

[56] References Cited

U.S. PATENT DOCUMENTS

| | | | |
|---|---|---|---|
| 1,980,101 | 11/1934 | Schneider | 2/10 |
| 2,719,972 | 10/1955 | Kelly | 2/8 |
| 2,980,914 | 4/1961 | Heisig et al. | 2/10 |
| 3,128,469 | 4/1964 | Lobelle | 2/6 |
| 3,517,392 | 6/1970 | Hodge et al. | 2/8 |
| 3,703,750 | 11/1972 | Irwin, Jr. | 2/10 |
| 3,720,956 | 3/1973 | Raschke | 2/8 |
| 4,028,739 | 6/1977 | Bell et al. | 2/6 |

FOREIGN PATENT DOCUMENTS

| | | | |
|---|---|---|---|
| 221320 | 7/1968 | Sweden | 2/8 |

*Primary Examiner*—Werner H. Schroeder
*Assistant Examiner*—Andrew M. Falik
*Attorney, Agent, or Firm*—Shenier & O'Connor

[57] ABSTRACT

A readily releasable powered visor-and-lock assembly for a helmet in which the visor is spring-biased for movement from a raised position behind a cover plate spaced from the helmet shell to a lowered position in front of the upper portion of the wearer's face. The cover plate is formed with a vertical slot having locking indentations at its upper and lower ends. A locking element secured to the upper portion of the visor extends outwardly through the slot and is biased in the direction of the locking indentations.

18 Claims, 8 Drawing Figures

Fig 5
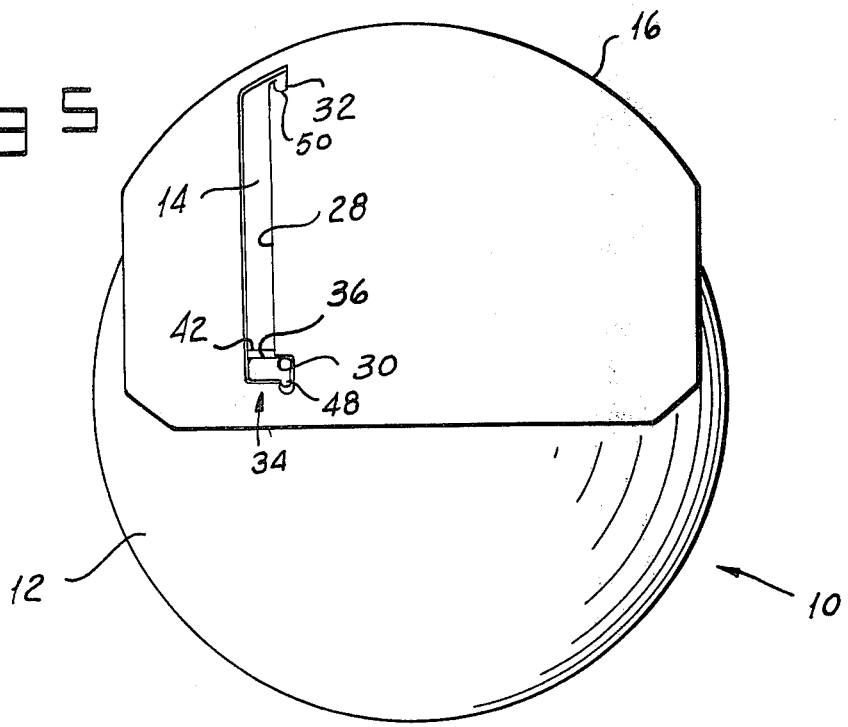
Fig 7
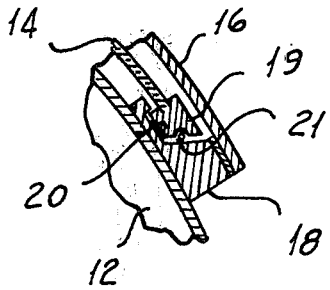
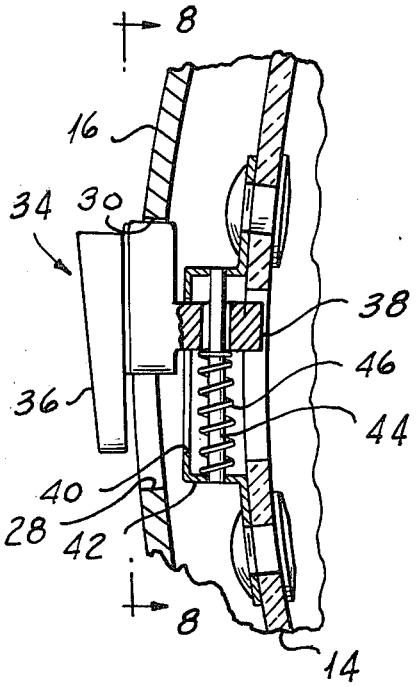
Fig 6
Fig 8
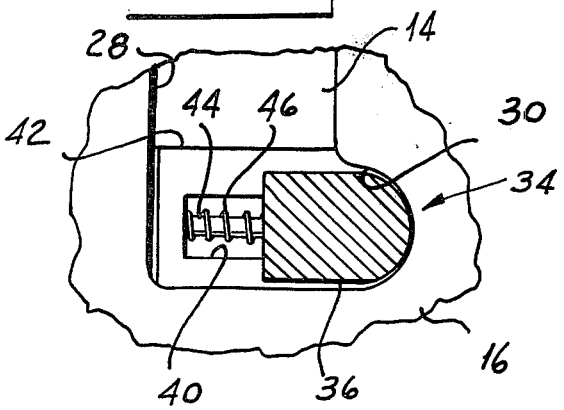

READILY RELEASABLE POWERED VISOR-AND-LOCK ASSEMBLY FOR HELMET

BACKGROUND OF THE INVENTION

In my prior patents, U.S. Pat. Nos. 3,906,547 and 3,055,013, I have disclosed helmet assemblies having visors movable between a lowered position in front of the wearer's face and a raised position behind a relatively rigid cover member. The visor may be releasable for movement by gravity to lowered position and may be locked in raised and lowered position. The visor may be movable to raised and lowered position and releasably held in those and intermediate position by detents and the like. While these helmet assemblies operate satisfactorily, it is desirable in certain military applications that the visor be rapidly and positively moved to its lowered position in response to the simple push of a finger, for example. Existing visor locks using screws or the like are relatively slow in operation and are difficult to operate with only one hand. Gravity does not provide the quick and certain action required.

SUMMARY OF THE INVENTION

One of the objects of my invention is to provide a powered visor-and-lock assembly for a helmet which rapidly and positively moves the visor to a lowered position.

Another object of my invention is to provide a powered visor-and-lock assembly which is readily manually actuatable.

Still another object of my invention is to provide a powered visor-and-lock assembly which operates reliably.

Other and further objects of my invention will be apparent from the following description.

In general, my invention contemplates a helmet in which the visor cover is formed with a vertical slot having a locking indentation at least at the upper end. A locking element secured to the upper portion of the visor extends outwardly through the slot and is biased in the direction of the locking indentation. The visor is biased toward its lowered position to provide quick and positive movement from an upper housed position in response to pushing the locking element out of the locking indentation.

BRIEF DESCRIPTION OF THE DRAWINGS

FIG. 5 is a top plan of my powered visor-and-lock assembly with the visor in a raised position.

FIG. 6 is an enlarged fragmentary section of the release mechanism of my powered visor-and-lock assembly taken along line 6—6 of FIG. 2.

FIG. 7 is an enlarged fragmentary section of the visor mounting means of my powered visor-and-lock assembly taken along line 7—7 of FIG. 2.

FIG. 8 is an enlarged fragmentary section of the release mechanism of my powered visor-and-lock assembly taken along line 8—8 of FIG. 6.

DETAILED DESCRIPTION OF THE PREFERRED EMBODIMENT

Figure 1:
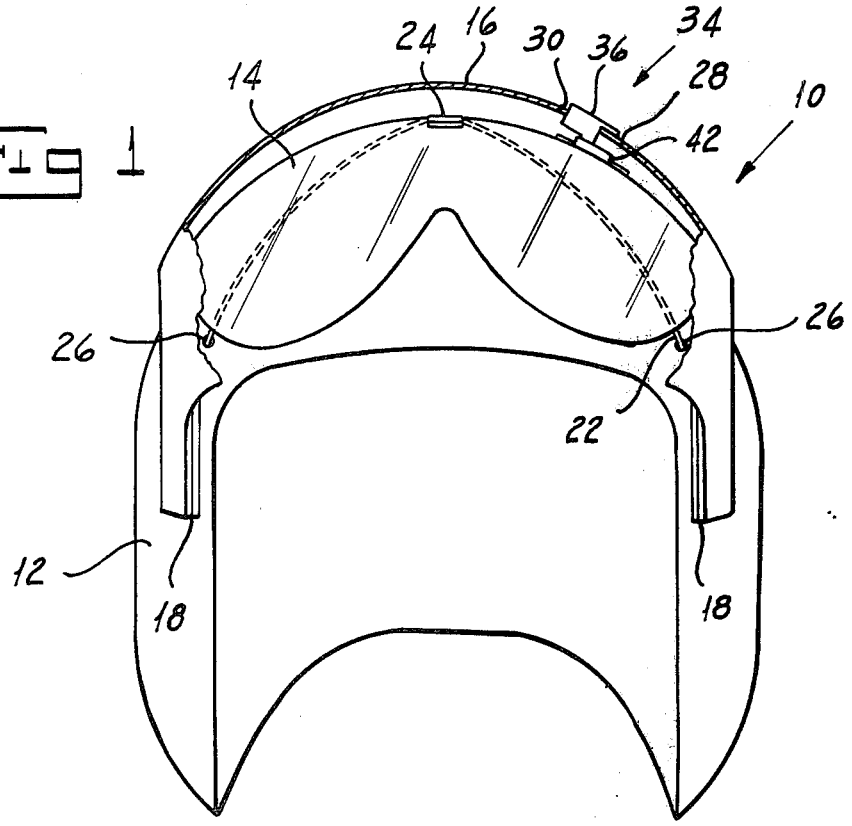
FIG. 1 is a front elevation of a helmet provided with my powered visor-and-lock assembly with a part broken away and with the visor in a raised position.
Figure 2:
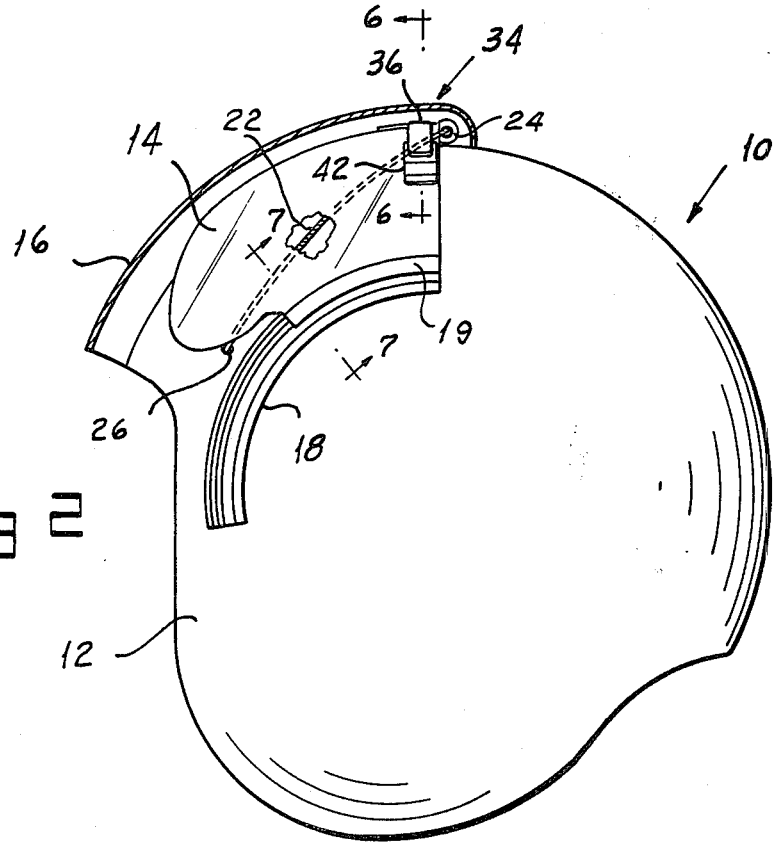
FIG. 2 is a side elevation of a helmet shown in FIG. 1 with a part in section and with the visor in a raised position.
Figure 3:
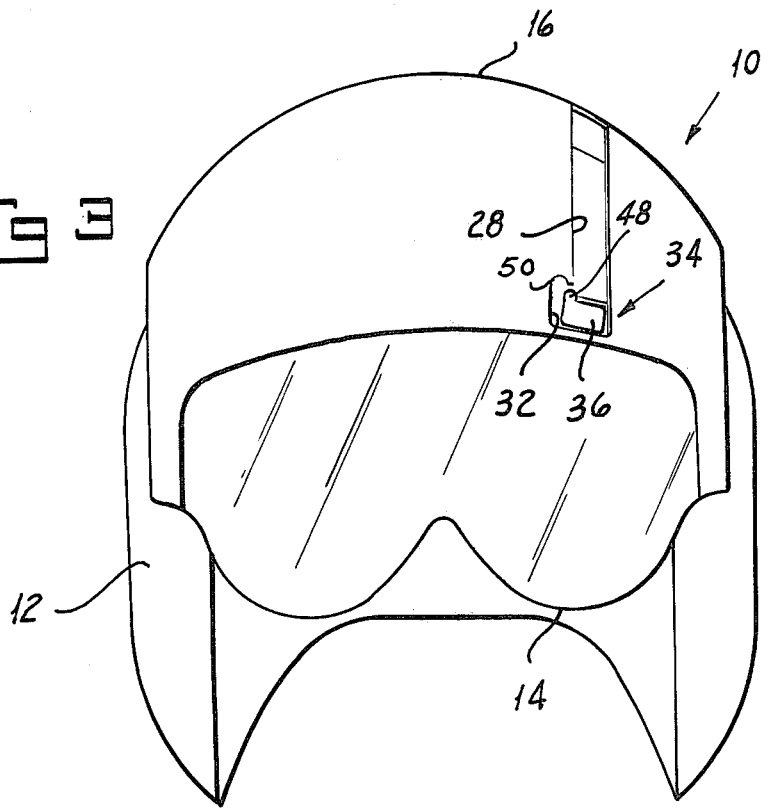
FIG. 3 is a front elevation of the helmet shown in FIG. 1 with the visor in a lowered position.
Figure 4:
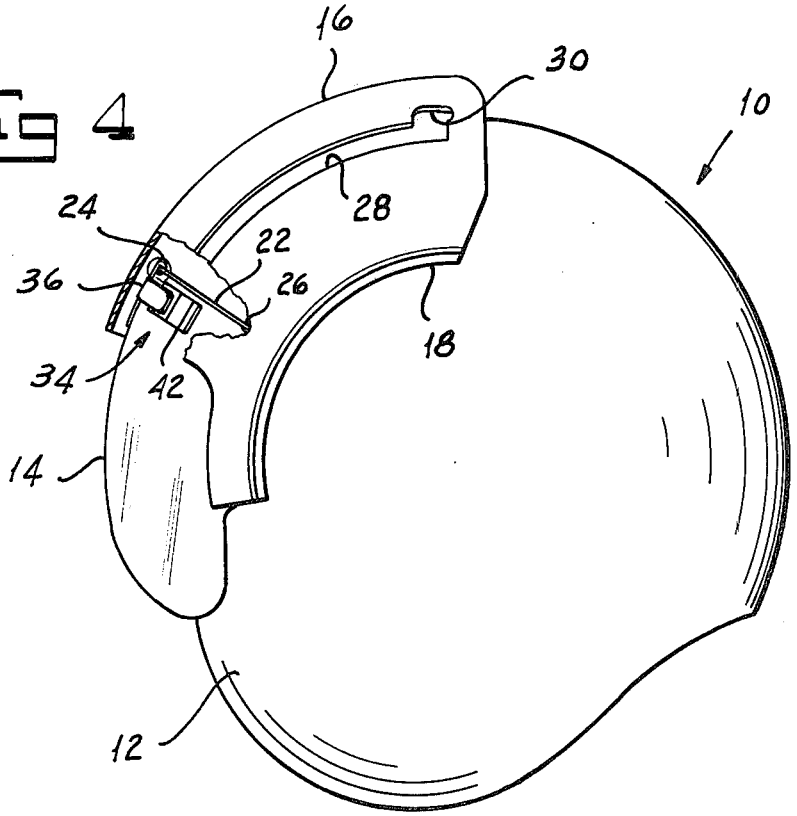
FIG. 4 is a side elevation of the helmet shown in FIG. 1 with a part in section and with the visor in a lowered position.

Referring now to the drawings, the helmet with which my powered visor-and-lock assembly is used, indicated generally by the reference numeral 10, includes a rigid shell 12 having a visor 14 movable on the outside of the shell 12 between a lower position in front of the upper portion of the wearer's face and an upper position. A cover member 16 fitted over the upper front portion of the shell 12 protects the visor 14 when it is in its upper or retracted position. Cover 16 is spaced from the visor 14 and the shell 12 by means of arc-shaped spacer members 18 suporting the sides of the cover 16. Runners 19 formed along the side edges of the visor 14 are slidably received in tracks 20 formed in the spacer members 18 to permit the visor 14 to move between upper and lower positions. Wire springs 21 disposed within grooves formed in the side edges of the runners 19 bias the visor 14 inwardly against the inner retaining walls of the members 18.

A clamp 24 secures the center of an elasticized cord 22 to the upper central portion of the visor 14. The ends of the cord 22 are passed through holes 26 formed in the shell 12 at points registering generally with the upper edge of the visor 14 in its lower position. The cord 22 is secured to the shell 12 by any suitable means, such as by knotting the ends of the cord passed through the holes 26. In this manner the visor is biased for positive rapid powered movement from its upper position to its lower position.

I form the cover 16 with a vertical slot 28 which is indented toward the right at the upper and lower ends to form an upper indentation 30 and a lower indentation 32. A release mechanism, indicated generally by the reference numeral 34, is secured to the visor 14 at its upper edge by means of rivets or the like so as to ride in the slot 28 when the visor 14 moves between its upper and lower positions. More particularly, the release mechanism 34 comprises an actuator member 36 having a depending portion 38 extending through a laterally extending slot 40 formed in the release mechanism housing 42. The depending portion 38 slidably receives a laterally extending pin 44 and is biased toward the right end of the slot 40 by a spring 46 carried on the pin 44. Preferably, the portion of the actuator abutting the inner wall of the indentation 30 or 32 is rounded, as shown in FIG. 8, to provide a smooth locking and release operation.

When the visor 14 is at its upper or lower limit position, as defined by the position of the indentations 30 and 32, the spring 46 biases the actuator member 36 into the indentation 30 or 32 to lock the visor 14 into position. If the visor 14 is locked in its upper position, it may be rapidly lowered simply by pushing the actuator member 36 toward the left to move it outside of the indentation 30, thus permitting the elastic cord 22 to draw the visor 14 downward. When the visor 14 reaches its lower limit position, the spring 46 biases the actuator member 36 into the lower indentation 32 to lock the visor 14 in its lower position. To raise the visor 14 from its lower position, the user simply pushes the actuator 36 toward the left to free it from the indentation 32 and then pushes the visor 14 upward until the actuator 36 slides into the indentation 30 to lock the visor 14 in its upper position.

Preferably, I provide actuator 36 with a projection 48 which is aligned with a recess 50 at the top of indentation 32 when the parts are in position corresponding to the lowered and locked visor positions. This feature prevents the visor from becoming accidentally unlocked when subjected to forces resulting from bailout or windblast.

It will be seen that I have accomplished the objects of my invention. By simply pushing the actuator toward the left with one hand, the wearer effects the rapid return of the visor to its lower position. The visor is self-locking both at the lower and at the upper positions. Finally, since the returning force is applied against the center of the visor rather than at a peripheral pivot point, for example, the returning force is applied in such a manner as to obtain the maximum mechanical advantage and to minimize the possibility of jamming.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A helmet-and-visor assembly including in combination, a helmet adapted to be received by the head of a wearer, a visor, means mounting said visor on said helmet for movement between a raised position clear of the eyes of the wearer and a lowered position in front of the eyes of the wearer, resilient means for positively biasing said visor for movement from said raised position to said lowered position, said resilient means comprising an elastic cord secured between said visor and said helmet, and readily manually releasable means for holding said visor in said raised position against the action of said biasing means.

2. An assembly as in claim 1 in which said elastic cord is secured to the upper central portion of said visor.

3. An assembly as in claim 1 in which a portion of said helmet is adjacent to the upper edge of said visor in its lowered position, said cord being secured to said helmet at spaced locations along said adjacent portion.

4. An assembly as in claim 3 in which said spaced locations are symetrically disposed with respect to the center plane of said helmet.

5. In a helmet-and-visor assembly including a helmet adapted to be received by the head of a wearer, a visor, and means mounting said visor on said helmet for movement between a raised position clear of the eyes of the wearer and a lowered position in front of the eyes of the wearer, the improvement comprising means forming a vertical slot in one of said helmet and visor, locking means mounted on the other of said visor and said helmet, said locking means having a locking element extending into said slot, and resilient means biasing said visor toward said lowered position and biasing said locking element toward one end of said slot, said slot having a lateral indentation at the other end thereof, said locking element being movable into said indentation to hold the visor against the action of said biasing means.

6. An assembly as in claim 5, said improvement further comprising means for biasing said locking element in the direction of said indentation.

7. An assembly as in claim 6 in which said locking means comprises a housing having a slot on one side thereof and having a pin mounted therein, said locking element having a depending portion extending into said housing through said slot and having a bore formed therein for slidably receiving said pin, said biasing means comprising a spring supported on said pin between said depending portion and said housing.

8. An assembly as in claim 5 in which said vertical slot is formed in said helmet and said locking means is mounted on said visor.

9. An assembly as in claim 8 in which a portion of said helmet overlies said visor when in said raised position, said slot being formed in said overlying portion.

10. An assembly as in claim 8 in which the uppermost portion of said helmet extends above the uppermost portion of said locking means when said visor is in said raised position.

11. An assembly as in claim 8 in which said slot is laterally spaced from the center plane of said helmet.

12. An assembly as in claim 8 in which said slot is on the left side of said helmet.

13. An assembly as in claim 5 in which said vertical slot has at the other end thereof a second lateral indentation, said locking element being biased in the direction of said second indentation.

14. An assembly as in claim 13 in which said second lateral indentation has a further indentation spaced from said slot and extending toward said first indentation, said locking element having a protruding portion adapted to engage said further indentation.

15. An assembly as in claim 5 in which said resilient means comprises an elastic cord secured between said visor and said helmet.

16. An assembly as in claim 15 in which said elastic cord is secured to the upper central portion of said visor.

17. An assembly as in claim 15 in which a portion of said helmet is adjacent to the upper edge of said visor in its lowered position, said cord being secured to said helmet at spaced locations along said adjacent portion.

18. An assembly as in claim 17 in which said spaced locations are symetrically disposed with respect to the center plane of said helmet.

* * * * *